US008194027B2

(12) United States Patent
Fujita et al.

(10) Patent No.: US 8,194,027 B2
(45) Date of Patent: Jun. 5, 2012

(54) LIQUID CRYSTAL DEVICE, LIGHT EMITTING DEVICE, ELECTRONIC APPARATUS, METHOD OF CONTROLLING LIQUID CRYSTAL DEVICE, AND METHOD OF CONTROLLING LIGHT EMITTING DEVICE

(75) Inventors: Shin Fujita, Suwa (JP); Yutaka Kobashi, Mizuho (JP); Shin Koide, Chino (JP); Tomoyuki Ito, Okaya (JP)

(73) Assignee: Sony Corporation, Tokyo (JP)

( * ) Notice: Subject to any disclaimer, the term of this patent is extended or adjusted under 35 U.S.C. 154(b) by 905 days.

(21) Appl. No.: 11/514,176

(22) Filed: Sep. 1, 2006

(65) Prior Publication Data

US 2007/0070002 A1 Mar. 29, 2007

(30) Foreign Application Priority Data

Sep. 29, 2005 (JP) ..... 2005-284456

(51) Int. Cl.
*G09G 3/36* (2006.01)

(52) U.S. Cl. ..... 345/102; 345/87; 345/77; 345/207; 345/204; 362/97.2; 362/561; 349/69; 349/70

(58) Field of Classification Search ..... 345/207, 345/102, 690, 87, 77, 204; 250/200, 552, 250/553; 315/169.3; 257/413, 431, 432, 257/40; 313/486, 500, 505–507; 362/97.1–97.3, 362/555, 561; 349/61, 68–71
See application file for complete search history.

(56) References Cited

U.S. PATENT DOCUMENTS

| | | | | |
|---|---|---|---|---|
| 2003/0231161 | A1* | 12/2003 | Yamaguchi | 345/102 |
| 2004/0207588 | A1* | 10/2004 | Shiomi | 345/87 |
| 2004/0263450 | A1* | 12/2004 | Lee et al. | 345/87 |
| 2009/0135212 | A1* | 5/2009 | Lee | 345/690 |

FOREIGN PATENT DOCUMENTS

| | | | |
|---|---|---|---|
| JP | A-3-249622 | | 11/1991 |
| JP | A-7-203157 | | 8/1995 |
| JP | A-2004-70195 | | 3/2004 |
| JP | A-2004-304289 | | 10/2004 |
| JP | 2005031572 | A * | 2/2005 |
| JP | A-2005-31572 | | 2/2005 |
| JP | A 2005-121977 | | 5/2005 |

OTHER PUBLICATIONS

U.S. Patent Application, filed in the name of Shin Fujita et al., on Sep. 15, 2006.
U.S. Patent Application, filed in the name of Shin Fujita et al., on Sep. 25, 2006.

* cited by examiner

*Primary Examiner* — Lun-Yi Lao
*Assistant Examiner* — Priyank Shah
(74) *Attorney, Agent, or Firm* — K&L Gates LLP

(57) ABSTRACT

A liquid crystal device is provided. The liquid crystal device includes: a liquid crystal panel including a pair of substrates which interpose a liquid crystal layer; a plurality of light receiving elements which detect ambient light; and a control unit which controls a display state of an image displayed on the liquid crystal panel based on an intensity of the ambient light detected by a plurality of the light receiving elements, wherein the control unit includes a determination unit determining that the intensity of the ambient light is changed when changed amounts of the intensities of the ambient light detected by equal to or more than half of the light receiving elements exceed a predetermined value.

8 Claims, 4 Drawing Sheets

LIQUID CRYSTAL DEVICE, LIGHT EMITTING DEVICE, ELECTRONIC APPARATUS, METHOD OF CONTROLLING LIQUID CRYSTAL DEVICE, AND METHOD OF CONTROLLING LIGHT EMITTING DEVICE

BACKGROUND

1. Technical Field

The present invention relates to a liquid crystal device, a light emitting device, an electronic apparatus, a method of controlling a liquid crystal device, and a method of controlling a light emitting device.

2. Related Art

In general, a liquid crystal device used as a display unit of an electronic apparatus includes a liquid crystal panel and a backlight which is disposed at the rear surface of the liquid panel as an illumination unit.

The backlight of the liquid crystal device may be an LED (Light Emitting Diode). A control circuit that controls an intensity of illumination light by adjusting current supplied to the LED is disposed in the liquid crystal device. In order for the liquid crystal panel to perform displaying with good quality according to external brightness of the electronic apparatus, there has been proposed an liquid crystal device including an optical sensor which detects an intensity of the ambient light and a control circuit which adjusts an intensity of a backlight based on the detection result obtained by using the optical sensor (see JP-A-2005-121997).

However, the liquid crystal device in the related art has the following problems. In the liquid crystal device of adjusting the intensity of the illumination light based on the intensity of the ambient light, for example, when a light receiving surface of an optical sensor is shielded with a hand (light shielding member) in mistake, the control circuit may determine that the intensity of the ambient light becomes weak. Therefore, there is a problem of malfunction that the intensity of the backlight may be adjusted based on the erroneously determined intensity of the ambient light.

SUMMARY

An advantage of some aspects of the invention is to provide a liquid crystal device, a light emitting device, an electronic apparatus, a method of controlling a liquid crystal device, and a method of controlling a light emitting device capable of preventing malfunction even though a light receiving surface of an optical sensor is shielded with a light shielding member in mistake.

According to an aspect of the invention, there is provided a liquid crystal device comprising: a liquid crystal panel including a pair of substrates which interpose a liquid crystal layer; a plurality of light receiving elements which detect ambient light; and a control unit which controls a display state of an image displayed on the liquid crystal panel based on an intensity of the ambient light detected by a plurality of the light receiving elements, wherein the control unit includes a determination unit determining that the intensity of the ambient light is changed when changed amounts of the intensities of the ambient light detected by equal to or more than half of the light receiving elements exceed a predetermined value.

According to another aspect of the invention, there is provided a method of controlling a liquid crystal device including a liquid crystal panel including a pair of substrates which interpose a liquid crystal layer and a plurality of light receiving elements which detect ambient light, the method comprising: detecting an intensity of the ambient light by using a plurality of the light receiving elements in a predetermined time interval; and controlling a display state of an image displayed on the liquid crystal panel by determining that the intensity of the ambient light is changed when changed amounts of the intensities of the ambient light detected by equal to or more than half of the light receiving elements exceed a predetermined value.

In the aspects of the invention, in a case where a portion of the light receiving elements are shielded with a hand in mistake or irradiated with light in mistake, even though the intensity of the ambient light detected by the light receiving elements is determined to be weak or strong, if the changed amounts of the intensities of the ambient light detected by equal to or more than half of the light receiving elements do not exceed a predetermined value, the intensity of the ambient light is determined not to be changed. Therefore, although the intensities different from actual intensities of a portion of the light receiving elements are detected, it is possible to prevent an erroneous conversion of the display state of an image displayed on the liquid crystal panel.

In addition, even though a portion of the light receiving elements are in disorder not to detect the ambient light, other light receiving elements can detect the ambient light, so that the display state of the image displayed on the liquid crystal panel can be converted.

In addition, in the liquid crystal device according to the above aspects, it is preferable that the determination unit determines that the intensity of the ambient light is changed when changed amounts of the intensities of the ambient light detected by more than half of the light receiving elements exceed a predetermined value.

In the aspects of the invention, the intensity of the ambient light is determined to be changed when the changed amounts of the intensities of the ambient light detected by more than half of the light receiving elements exceed a predetermined value, so that it is possible to more effectively prevent occurrence of malfunction.

In addition, in the liquid crystal device according to the above aspects, it is preferable that the liquid crystal device further comprises an illumination unit which irradiates illumination light on a rear surface of the liquid crystal panel, and the control unit controls an intensity of the illumination light based on the determination of the determination unit.

In the aspects of the invention, since the control unit controls the intensity of the illumination light irradiated from the illumination unit based on the intensity of the ambient light, image display can be appropriately performed by the liquid crystal panel irrespective of brightness of the ambient light of the liquid crystal device, and power consumption for irradiating the illumination light can be reduced.

According to still another aspect of the invention, there is provided a light emitting device comprising: an electro-optical panel including a pair of substrates which interpose an electro-optical material layer; a plurality of light receiving elements which detect ambient light; and a control unit which controls a display state of an image displayed on the electro-optical panel based on an intensity of the ambient light detected by a plurality of the light receiving elements, wherein the control unit includes a determination unit determining that the intensity of the ambient light is changed when changed amounts of the intensities of the ambient light detected by equal to or more than half of the light receiving elements exceed a predetermined value.

According to further still another aspect of the invention, there is provided a method of controlling a light emitting device including an electro-optical panel including a pair of substrates which interpose an electro-optical material layer and a plurality of light receiving elements which detect ambient light, the method comprising: detecting an intensity of the ambient light by using a plurality of the light receiving elements in a predetermined time interval; and controlling a display state of an image displayed on the electro-optical panel by determining that the intensity of the ambient light is changed when changed amounts of the intensities of the ambient light detected by equal to or more than half of the light receiving elements exceed a predetermined value.

In the aspects of the invention, as described above, although the intensities different from actual intensities of a portion of the light receiving elements are detected, it is possible to prevent an erroneous conversion of the display state of an image displayed on the electro-optical panel.

In addition, the display state of the image displayed on the electro-optical panel can be optimally controlled based on the intensity information, so that it is possible to prevent excessive voltage form being applied to, for example, an electro-optical material layer. Therefore, the life cycle of the electro-optical material layer can be prolonged.

According to further still another aspect of the invention, there is provided an electronic apparatus having the aforementioned liquid crystal device.

According to further still another aspect of the invention, there is provided an electronic apparatus having the aforementioned light emitting device.

In the aspects of the invention, since the aforementioned liquid crystal device or light emitting device is provided, although the intensities different from actual intensities of a portion of the light receiving elements are detected, it is possible to prevent an erroneous conversion of the display state of an image displayed on the liquid crystal panel or the electro-optical panel.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
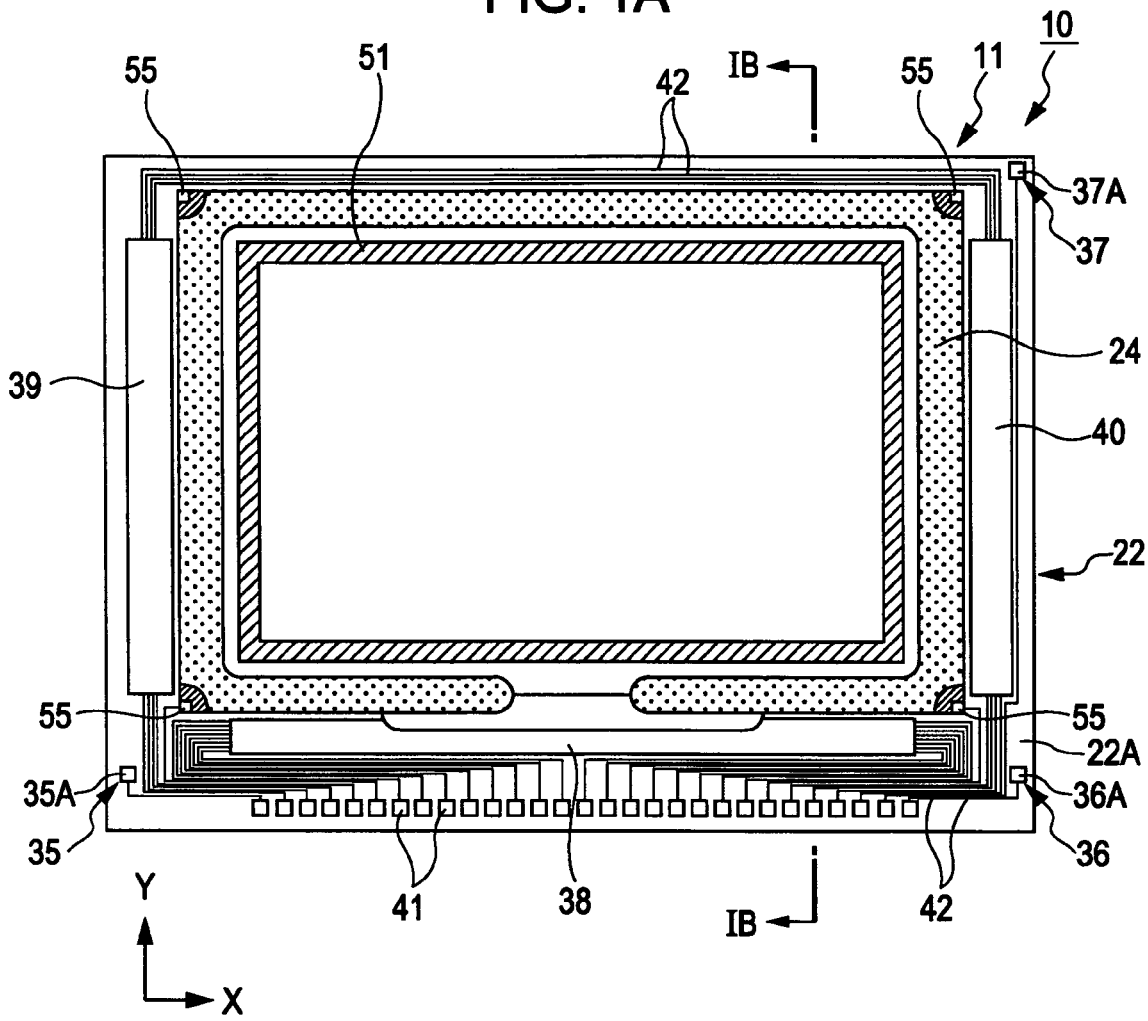
FIG. 1A is a plan view showing a liquid crystal device according to an embodiment.
Figure 1B:
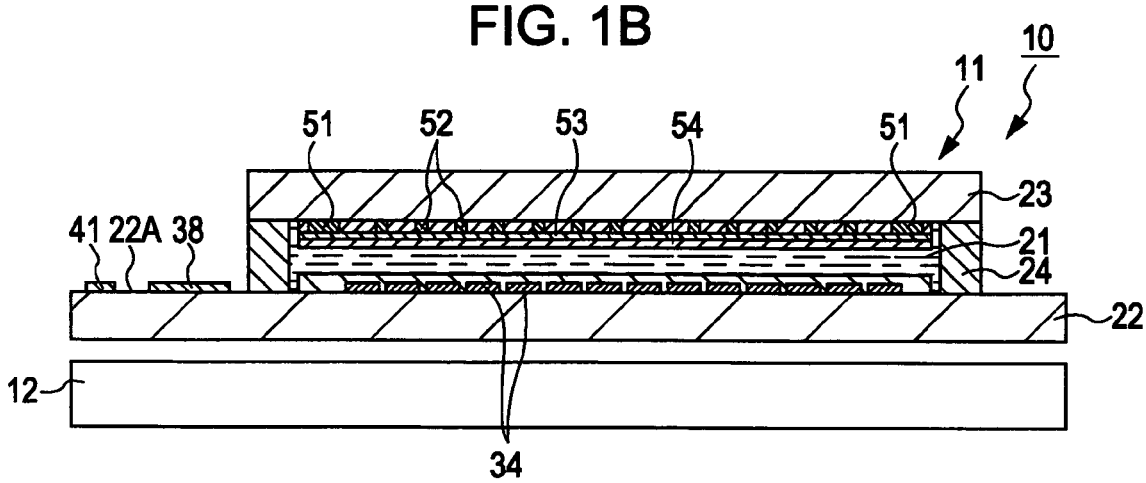
FIG. 1B is a cross-sectional view thereof.
Figure 2:
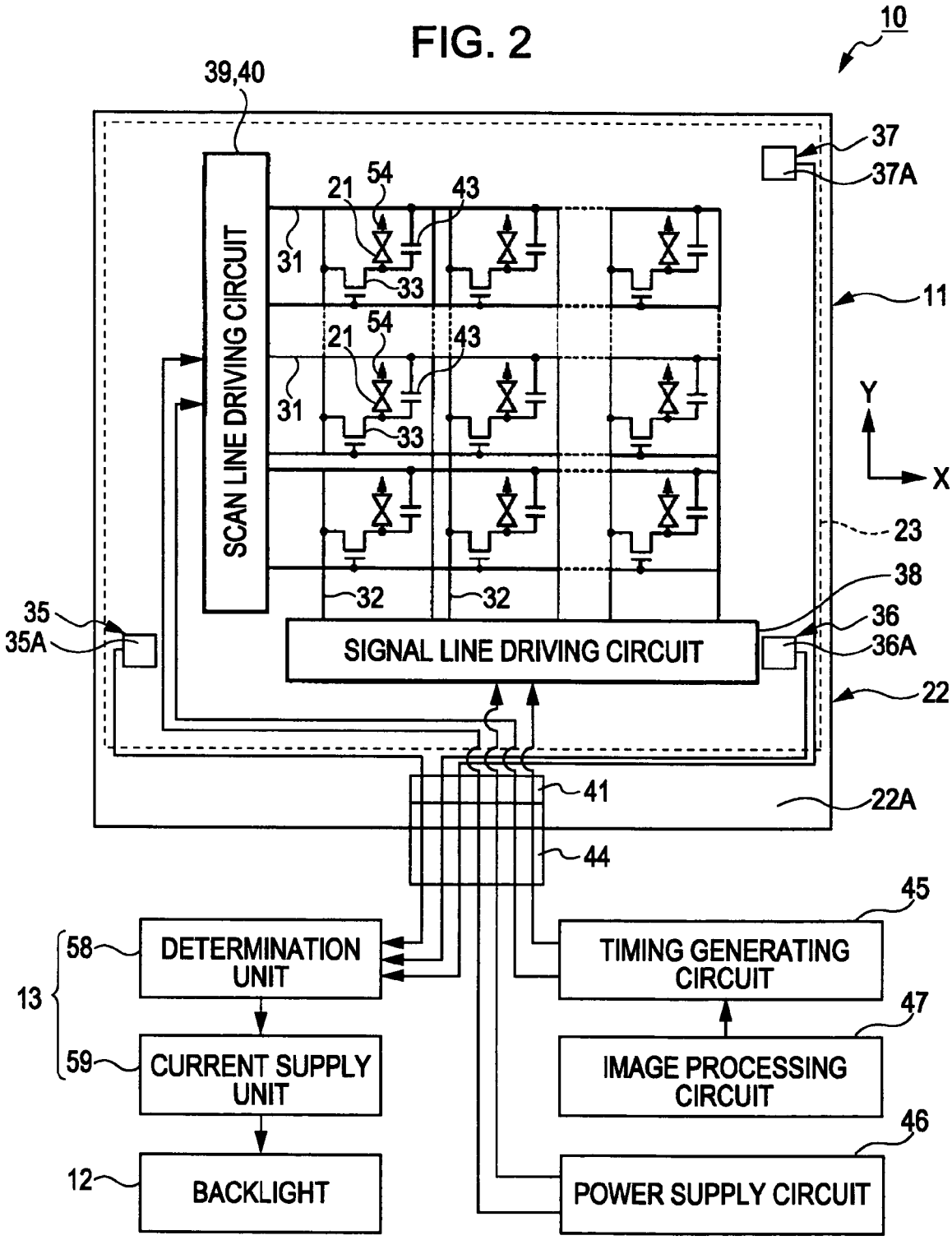
FIG. 2 is a circuit diagram of the liquid crystal device.

Hereinafter, a liquid crystal device and an electronic apparatus according to an embodiment of the invention will be described with reference to the accompanying drawings. FIG. 1A is a plan view showing a liquid crystal device according to an embodiment, and FIG. 1B is a cross-sectional view taken along line IB-IB. FIG. 2 is a circuit diagram showing a circuit construction of the liquid crystal device.

A liquid crystal device 10 is a semi-transmissive reflective TFT (Thin Film Transistors) active matrix type liquid crystal device. As shown in FIGS. 1A, 1B, and 2, the liquid crystal device 10 includes liquid crystal panel 11, a backlight (illumination unit) 12 disposed in the rear surface of the liquid crystal panel 11, and a backlight control circuit (illumination light control unit) 13 which controls an intensity of the illumination light by adjusting a current supplied to the backlight 12.

As shown in FIG. 1A, the liquid crystal panel 11 includes a TFT array substrate (a substrate) 22 and an opposite substrate (another substrate) 23 which interpose an liquid crystal layer 21 and a sealing member 24 which is disposed at edges of facing surfaces of the first and second substrates 22 and 23 and has a substantially rectangular shape as seen from a plan view so as to seal the liquid crystal layer 21. In the liquid crystal panel 11, an image display area 25 is defined by an inner portion of a sealed area surrounded by the TFT array substrate 22 and the opposite substrate 23 which overlap each other and a peripheral shielding layer 51 (described below) which is formed in an inner side of the sealing member 24. In the liquid crystal panel 11, the TFT array substrate 22 is a rear side substrate, and the opposite substrate 23 is a front side substrate.

Polarizing plates (not shown) are disposed on the front and rear surfaces of the liquid crystal panel 11, respectively. A pair of the polarizing plates transmit only linearly polarized light that vibrate in a specific direction. Transmission axes of the polarizing plates are disposed to be substantially perpendicular to each other and intersect a rubbing direction of the alignment film with an angle of about 45°.

For example, the liquid crystal layer 21 is formed of a liquid crystal in which one type or multiple types of nematic liquid crystals are mixed, and is disposed in a specific alignment state between alignment films (not shown) respectively formed on the TFT array substrate 22 and the Opposite substrate 23. The liquid crystal layer 21 may have a TN (Twisted Nematic) mode that uses a liquid crystal having a positive dielectric anisotropy or a VAN (Vertical Aligned Nematic) mode that uses a liquid crystal having a negative dielectric anisotropy.

The TFT array substrate 22 has a rectangular shape when seen from a plan view and is made of an optical transmissive material such as quartz, glass, plastic, or the like. In addition, the TFT array substrate 22 is formed with a protrusion region 22A which protrudes outwards with respect to the opposite substrate 23 in one edge thereof.

In a region where the TFT array substrate 22 overlaps the image display area 25, a plurality of scan lines 31, signal lines 32, TFTs 33, and pixel electrodes 34 are provided. In side regions of the image display area 25 of the TFT array substrate 22, first to third light receiving elements (light receiving means) 35 to 37 are provided. In addition, a signal line driving circuit 38 is disposed along one side of the TFT array substrate 22. In addition, scan line driving circuits 39 and 40 are disposed along two sides adjacent to the one side of the TFT array substrate 22. In the protrusion regions 22A of the TFT array substrate 22, there are provided terminals 41, that is, a group of terminals of the first to third light receiving elements 35 to 37, the signal line driving circuit 38, and the scan line driving circuits 39 and 40. In addition, the first to third light receiving elements 35 to 37, the signal line driving circuit 38, the scan line driving circuits 39 and 40, and the terminals 41 are suitably electrically connected to each other with wire lines 42.

As shown in FIG. 2, the scanning lines 31 are wire lines extending in the X direction and made of a metal such as aluminum. In addition, as shown in FIG. 2, the signal lines 32 are wire lines extending in the Y direction to intersect the scanning lines 31. Similarly to the scanning lines 31, the signal lines 32 are made of a metal such as aluminum. Pixel areas are formed by the scanning lines 31 and the signal lines 32.

Each pixel area is surrounded by the scanning lines 31 and the signal lines 32. In addition, as seen from a plan view, the pixel area is formed to overlap an area where a color filter (not shown) is disposed on the opposite substrate 23.

For example, each of the TFTs 33 is constructed with an n-type transistor. The TFTs 33 are disposed at intersections between the scanning lines 31 and the signal lines 32. In addition, the TFTs 33 are constructed by partially forming an amorphous polysilicon layer or a polysilicon layer crystallized with the amorphous polysilicon layer on the upper surface of the TFT array substrate 22 and partially doping and activating impurities thereon.

The scanning lines 31 are respectively electrically connected to gates of the TFTs 33. The pixel electrodes 34 are respectively electrically connected to drains of the TFTs 33.

In order to prevent image signals stored in the pixel electrodes 34 from leaking, storage capacitors 41 are connected to the pixel electrodes 34 in parallel.

The pixel electrodes 34 are made of an optical transmissive conductive material such as ITO (Indium Tin Oxide). Each of the pixel electrodes 34 is arranged to face an opposite electrode 54 (described later) disposed on the opposite substrate 23. In addition, the liquid crystal layer 21 is interposed between the pixels electrodes 34 and the opposite electrode 54 which is disposed on the opposite substrate 23 to face the pixel electrodes 34. Furthermore, the pixel electrodes 34 are provided with a reflecting layer (not shown).

The first to third light receiving elements 35 to 37 may be constructed with a photodiode, a phototransistor, or the like. The first light receiving element 35 is disposed so as for a first light receiving surface 35A, that is, a light receiving surface of the first light receiving element 35 to be located at a lower left side of the image display area 25 in FIG. 1A. The second light receiving element 36 is disposed so as for a second light receiving surface 36A to be located at a lower right side of the image display area 25, and the third light receiving element 37 is disposed so as for a third light receiving surface 37A to be located at an upper right side of the image display area 25. Namely, the first to third light receiving elements 35 to 37 are disposed so as for the light receiving surfaces thereof to be separated from each other at the sides of the image display area 25. Therefore, a probability that more than two of the first to third light receiving surfaces 35A to 37A are shielded in mistake can be reduced.

When the backlight control circuit 13 transmits a detection start signal, the first to third light receiving elements 35 to 37 receive the ambient light though the first to third light receiving surfaces 35A to 37A and output opto-electrically transformed electrical signals as intensity information to the backlight control circuit 13.

In a case where the first to third light receiving elements 35 to 37 are constructed with a PIN (Positive Intrinsic Negative) type photodiode, the PIN-type photodiode can be formed such that, when a semiconductor layer constituting the first to third light receiving elements 35 to 37 are defined as an intrinsic semiconductor region (I layer) in which an intrinsic semiconductor or a negligible concentration of impurity is introduced, a p-type semiconductor region (P layer) is formed in one side of the intrinsic semiconductor region (I layer), whereas an n-type semiconductor region (N layer) is formed on the other side thereof. By utilizing a semiconductor layer that is formed in the same process as that of the TFT 33, the PIN-type photodiode may be formed in the same manufacturing process as that of the TFT 33.

As shown in FIG. 2, the signal line driving circuit 38 is constructed so as to supply image signals to a plurality of signal lines 32. Here, the image signals input to the signal lines 32 by the signal line driving circuit 38 may be supplied in the line order or in groups of adjacent signal lines 32.

The signal line driving circuits 39 and 40 are constructed so as to supply scan signals to a plurality of scanning lines 31 at a predetermined timing in the form of pulse in the line order.

The signal line driving circuit 38 and the scanning line driving circuits 39 and 40 are constructed with an electrical circuit in which a transistor, a diode, a capacitor, and so on are combined, and are formed by partially introducing or activating impurities with respect to an amorphous polysilicon layer or a polysilicon layer crystallized with the amorphous polysilicon layer which is partially formed on the upper surface of the TFT array substrate 22, like the TFTs 33 or the light receiving element 35. Therefore, the signal line driving circuit 38 can be formed by the same manufacturing process as those of the TFT 33 or the light receiving element 35.

The terminals 41 are connected to one end of a flexible board 44 by using an anisotropic conductive material such as an ACF (Anisotropic Conductive Film) or an ACP (Anisotropic Conductive Paste). Through the flexible board 44, a timing generating circuit 45 and the scanning line driving circuits 39 and 40 are electrically connected, a power circuit 46, the signal line driving circuit 38, and the scanning line driving circuits 39 and 40 are electrically connected, and the first to third light receiving elements 35 to 37 and the backlight control circuit 15 are electrically connected. The timing generating circuit 45 is connected to an image processing circuit 47.

Similar to the TFT array substrate 22, the opposite substrate 23 has a rectangular shape as seen from a plan view and is made of an optical transmissive material such as glass or plastic. On the lower surface of the liquid crystal layer 21 of the opposite substrate 23, the peripheral shielding layer 51, a display area shielding layer 52, a color filter layer 53, the opposite electrode 54, and an alignment film (not shown) are stacked in this order.

The peripheral shielding layer 51 has a shape of a rectangular frame as seen from a plan view and is disposed along the inner circumferential surface of the sealing member 24, to define the image display area.

The display area shielding layer 52 has a grid or stripe shape as seen from a plan view and is disposed to cover the image display area 25, that is, an area inside the peripheral shielding layer 51.

The color filter layer 53 is constructed with a plurality of color filters which are arranged in matrix as seen from a plan view, so as to correspond to the pixel areas described above.

Similar to the pixel electrode 34, the opposite electrode 54 is a flat layer made of an optical transmissive conductive material such as ITO.

Four corner portions of the opposite substrate 23 are provided with upper and lower conductive materials 55 which function as upper and lower conductive terminals between the opposite substrate 23 and the TFT array substrate 22. The upper and lower conductive materials 55 are used to electrically connect the opposite substrate 23 and the TFT array substrate 22.

The sealing member 24 has a shape of a rectangular frame as seen from a plan view and is in contact with the TFT array substrate 22 and the opposite substrate 23. The sealing member 24 is constructed with a UV curable resin, a thermosetting resin, or the like and is subject to a curing process by irradiating an ultraviolet ray or heating after being coated at a specific position of the TFT array substrate 22. In addition, the sealing member 24 is mixed with a gap material such as glass fiber or glass beads in order to allow a distance (gap between substrates) between the TFT array substrate 22 and the opposite substrate 23 to have a predetermined value.

The backlight 12 includes a light source which is constructed with a white LED or the like, a light guide plate which guides illumination light irradiated by the light source, and a reflector.

As shown in FIG. 2, the backlight control circuit 13 includes a determination unit (determination means) 58 which is electrically connected to the first to third light receiving elements 35 to 37 through a flexible board 44 and a current supply unit 59 which is electrically connected to the backlight 12.

Figure 3:
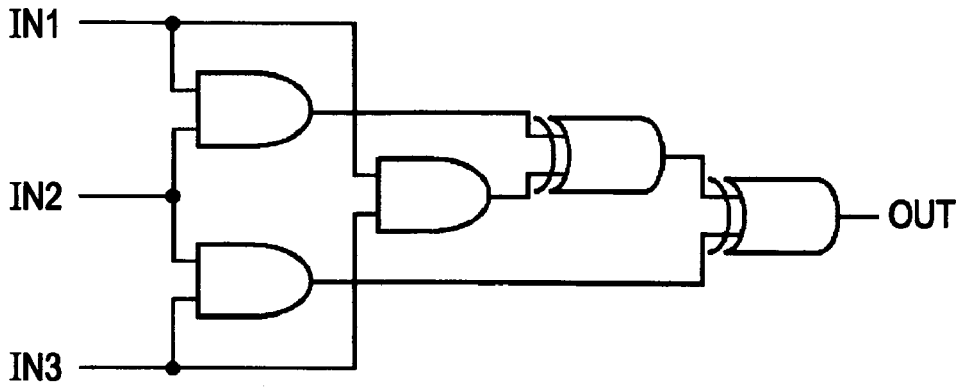
FIG. 3 is a view showing a logic circuit provided to a determination unit.

The determination unit 58 transmits the detection start signal to the first to third light receiving elements 35 to 37 in a predetermined time interval so as to receive the ambient light. The determination unit 58 receives the intensity information from the first to third light receiving elements 35 to 37 and calculates the intensity of the ambient light from the received intensity information. In addition, the determination unit 58 include a recording unit (not shown) such as a memory which stores the intensities of the ambient light that are previously received from the first to third light receiving elements 35 to 37 in response to transmission of the detection start signal. The determination unit 58 is constructed to calculate changed amounts of the intensities of the ambient light received by the first to third light receiving elements 35 to 37. In addition, as shown in FIG. 3, the determination unit 58 includes a logic circuit so as to determine that the intensity of the ambient light is changed when the changed amounts of the intensities of more than two of the first to third light receiving elements 35 to 37, that is, more than half thereof exceed a predetermined value. A truth table of the logic circuit is as follows. In table 1, if the changed amount of the intensity of each of the first to third light receiving elements 35 to 37 exceeds a predetermined value, IN1 to IN3 are represented by 1, and if not, by 0. In addition, a case where the determination unit 58 determines that the intensity of the ambient light is changed is represented by 1, and a case where the determination unit 58 does not determine that the intensity of the ambient light is changed is represented by 0.

TABLE 1

| IN1 | IN2 | IN3 | IN4 |
|---|---|---|---|
| 1 | 1 | 1 | 1 |
| 1 | 1 | 0 | 1 |
| 1 | 0 | 1 | 1 |
| 1 | 0 | 0 | 0 |
| 0 | 1 | 1 | 1 |
| 0 | 1 | 0 | 0 |
| 0 | 0 | 1 | 0 |
| 0 | 0 | 0 | 0 |

0: changed amount exceeds a predetermined value
1: changed amount dose not exceed a predetermined value When the intensity of the ambient light is determined to be changed, the determination unit 58 calculates an average value of the intensities of the ambient light corresponding to the light receiving elements that detect the changed amounts of the intensities of the ambient light among the first to third light receiving elements 35 to 37 and outputs the average value to the current supply unit 59.

The current supply unit 59 adjusts the current to be supplied to the backlight 12 based on the intensity of the ambient light calculated by the determination unit 58 to control the intensity of the illumination light.

When the intensity of the ambient light is equal to or less than a threshold value T1, the current supply unit 59 allows the backlight 12 to irradiate the illumination light, so that the liquid crystal panel 11 is in the transmissive display mode. When the intensity of the ambient light exceeds a threshold value T2 higher than the threshold value T1, the current supply unit 59 allows the backlight 12 not to irradiate the illumination light, but the ambient light is reflected by the reflecting layer so as to be used as the illumination light, so that the liquid crystal panel 11 is in the transmissive display mode.

Figure 4:
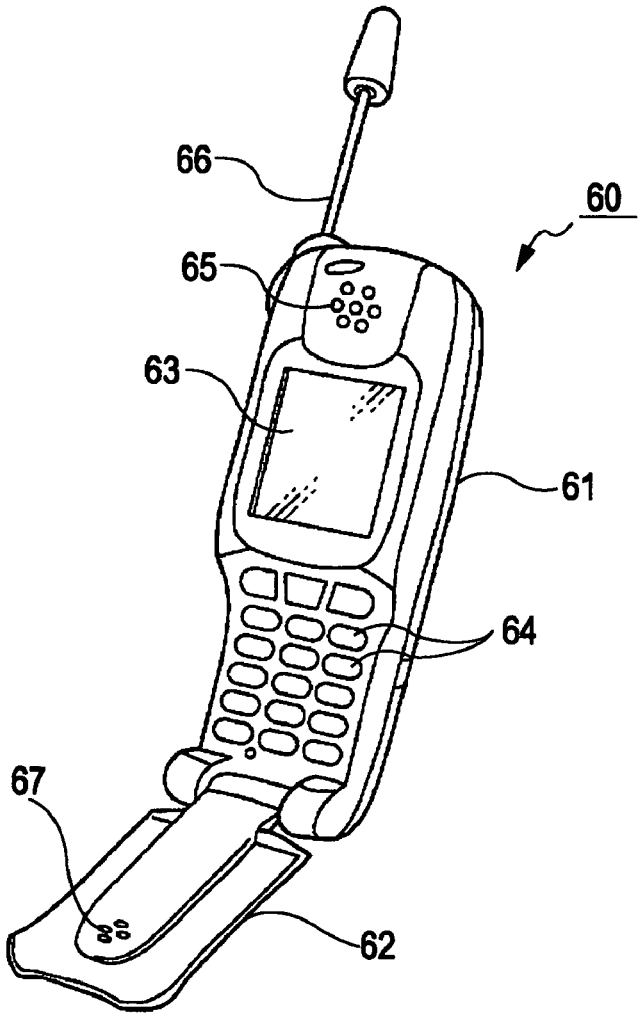
FIG. 4 is a perspective view showing an outer appearance of a mobile phone according to an embodiment.

The liquid crystal device 10 having the aforementioned structure is employed by a mobile phone (n electronic apparatus) 60 as shown in FIG. 4. FIG. 4 is a perspective view of a mobile phone.

The mobile phone 60 includes a body 61 and a cover 62 which is connected to the lower end of the body 61 via a hinge mechanism. The cover 62 can be freely open and closed against the body 61. In addition, the body 61 includes a display unit 63 constructed with the aforementioned liquid crystal device 10, an operation unit 64 arranged with a plurality of operation keys, an earpiece 65, and an antenna 66. The cover 62 includes a mouthpiece 67.

Now, a method of controlling the intensity of the illumination light of the backlight 12 based on the intensity of the ambient light in the mobile phone 60 employing the liquid crystal device 10 having the aforementioned structure will be described with reference to FIG. 5.

Figure 5:
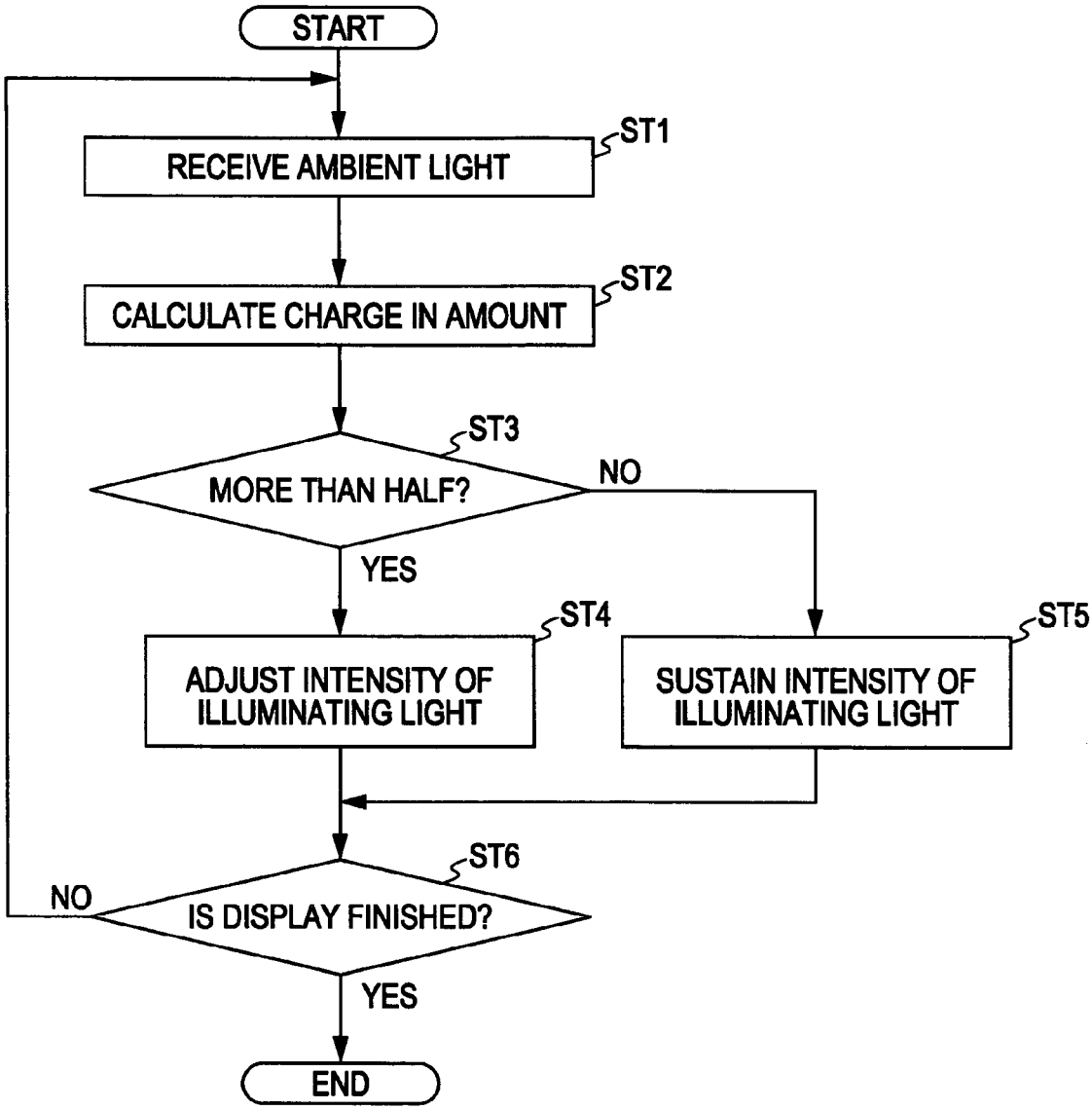
FIG. 5 is a flowchart showing a determination method performed by a determination unit according to an embodiment.

Firstly, the determination unit 58 transmits a detection start signal to the first to third light receiving elements 35 to 37, and the first to third light receiving elements 35 to 37 receives the ambient light (Step ST1 in FIG. 5). Next, the first to third light receiving elements 35 to 37 outputs opto-electrically transformed electrical signals as intensity information to the determination unit 58.

Next, the determination unit 58 calculates changed amounts of the intensities detected by the first to third light receiving elements 35 to 37 with respect to the intensity of the ambient light based on the received intensity information and stores the changed amounts in the recording unit (Step ST2 in FIG. 5).

The determination unit 58 determines whether or not the changed amounts of the intensities of the ambient light detected by more than two of the first to third light receiving elements 35 to 37, that is, more than half thereof, exceed a predetermined value (Step ST3 in FIG. 5). In the determination, the intensity of the ambient light detected by the first to third light receiving elements 35 to 37 at the time of transmission of the previous detection start signal is read out from the recording unit and compared with the intensities of the ambient light detected in Step ST1.

If the determination unit 58 determines that the intensity of the ambient light is changed in Step ST3, the current supply unit 59 adjusts the current amount to be supplied to the backlight 12 to control the intensity of the illumination light in the backlight 12 (Step ST4 in FIG. 5). More specifically, the current supply unit 59 controls the intensity of the illumination light in the backlight 12 based on an average value of the intensities of the ambient light corresponding to the light receiving elements that detect the changed amounts of the intensities of the ambient light among the first to third light receiving elements 35 to 37.

If the determination unit 58 does not determine that the intensity of the ambient light is changed in Step ST3, the intensity of the illumination light in the backlight 12 is maintained (Step ST5 in FIG. 5). By doing so, in a case where a portion of the first to third light receiving elements 35 to 37 are shielded with a hand (light shielding means) in mistake or irradiated with light in mistake, even though the intensities of the ambient light detected by a portion of the light receiving elements are different from an actual intensity of the ambient light, it is possible to prevent an erroneous adjustment of the intensity of the illumination light. In addition, since the first to third light receiving elements 35 to 37 are disposed so as for the light receiving surfaces thereof to be separated from each other at the sides of the image display area 25, a probability that more than two of the first to third light receiving surfaces 35A to 37A are shielded in mistake can be reduced.

After the intensity of the illumination light is adjusted in Step ST4 or after the intensity of the illumination light is maintained in Step ST5, it is determined whether or not the image display is continuously performed by the light crystal device 10 (Step ST6 in FIG. 5).

In a case where the image display of the light crystal device 10 is continuously performed in Step ST6, after a predetermined time, the operation returns to Step ST1, and the determination unit 58 transmits the detection start signal, so that the detection of the ambient light is performed again.

In a case where the image display of the light crystal device 10 is finished in Step ST6, the irradiation of the illumination light ends.

According to the above descried steps, the intensity of the illumination light of the backlight 12 is controlled.

According to the liquid crystal device 10 and the methods of controlling the mobile phone 1 and the liquid crystal devices having the aforementioned construction, in a case where a portion of the first to third light receiving elements 35 to 37 are shielded with a hand or the like in mistake or irradiated with light in mistake, even though the intensities of the ambient light detected by a portion of the light receiving elements are different from an actual intensity of the ambient light, if the changed amounts of the intensities of equal to or more than two of the first to third light receiving elements 35 to 37 do not exceed a predetermined value, the determination unit 58 does not determine that the intensity of the ambient light is changed. Therefore, it is possible to prevent an erroneous adjustment of the intensity of the illumination light. In addition, in a case where one of the first to third light receiving elements 35 to 37 is in disorder, the ambient light can be detected by the other two light receiving elements, so that the adjustment of the intensity of the illumination light can be performed.

In addition, since the intensity of the illumination light is controlled based on the intensity of the ambient light, image display can be appropriately performed by the liquid crystal panel 11 irrespective of brightness of the ambient light of the liquid crystal device, and power consumption for irradiating the illumination light can be reduced.

The invention is not limited to the above embodiments, and various changes in form may be made therein without departing from the scope and spirit of the invention.

For example, in the aforementioned embodiments, the light receiving elements are disposed at three positions. However, the light receiving elements may be disposed at a plurality of position, for example, two positions, four positions, or more.

In a case where two light receiving elements are disposed, the two light receiving elements may be disposed so as for the light receiving surfaces thereof at the upper right side and the left side of the image display area shown in FIG. 1A, respectively. If the intensities of the ambient light detected by the two light receiving elements exceed a predetermined value, the determination unit determines that the intensity of the ambient light is changed. If not, the determination unit does not determine that the intensity of the ambient light is changed. In a case where four light receiving elements are disposed, the four light receiving elements may be disposed so as for the light receiving surfaces thereof at the lower right, upper right, lower left, and upper left sides of the image display area shown in FIG. 1A, respectively. If the intensities of the ambient light detected by equal to or more than three light receiving elements exceed a predetermined value, the intensity of the ambient light is determined to be changed. If not, the intensity of the ambient light is not determined to be changed.

In addition, in the aforementioned embodiment, the determination unit determines that the intensity of the ambient light is changed when the changed amounts of the intensities of more than half of the light receiving elements exceed a predetermined value. However, the determination unit may determine that the intensity of the ambient light is changed when the changed amounts of the intensities of equal to or more than half of the light receiving elements exceed a predetermined value. In other word, the determination unit may determine that the intensity of the ambient light is changed even though the number of the light receiving elements that detect the intensities exceeding a predetermined value is equal to the number of the light receiving elements that detect the intensities not exceeding a predetermined value.

In addition, if the intensities detected by some of the light receiving elements increase to exceed a predetermined value, and if the intensities detected by other of the light receiving elements decreases to exceed a predetermined value, the outputs of the light receiving elements may be different from each other. In this case, the intensity of the ambient light may be determined not to be changed.

In addition, in the aforementioned embodiment, the current supply unit adjusts the current amount to be supplied to the backlight based on an average value of the intensities corresponding to the light receiving elements that detect the intensities of the ambient light exceeding a predetermined value. However, the current amount may be adjusted by using other methods such as a method of adjusting the current amount based on the intensity of the ambient light corresponding to one of the light receiving elements that detect the intensities of the ambient light exceeding a predetermined value.

In addition, in the aforementioned embodiment, the intensity of the illumination light is controlled based on the intensity of the ambient light received by the light receiving element. However, an image to be displayed on the liquid panel may be corrected based on the intensity of the ambient light.

In addition, in the aforementioned embodiment, a semi-transmissive reflective liquid crystal device is used. However, a transmissive liquid crystal device may be used.

In addition, in the aforementioned embodiment, the light receiving elements are disposed on the TFT array substrate. However, if the light receiving surfaces can receive light, the light receiving elements may be disposed on the opposite substrate. In addition, the light receiving surfaces may be disposed in the vicinity of a display portion of a case of a mobile phone.

In addition, in the aforementioned embodiment, a transmissive liquid crystal device which displays an image on the liquid crystal panel by using the illumination light irradiated from the backlight irrespective of the ambient light is employed. However, a semi-transmissive reflective liquid crystal device which displays an image by using the illumination light of the backlight in case of weak ambient light and by reflecting the ambient light incident on the front surface side of the liquid crystal panel with a reflecting layer in case of strong ambient light may be employed.

In addition, in the aforementioned embodiment, the liquid crystal panel has an active matrix structure. However, the liquid crystal panel may have a passive matrix structure. In this case, a reed-shaped transparent electrode is arranged in a stripe form on one side of a substrate corresponding to the TFT array substrate as seen from a plan view, so as to have a structure in which a reed-shaped transparent electrode is arranged in a stripe form on the other side of a substrate corresponding to the opposite substrate, as seen from a plan view, in a cross manner with respect to the transparent electrode formed on the one side of the substrate.

In addition, in the aforementioned embodiment, the color filter is formed on the upper surface of the liquid crystal layer of the opposite substrate. However, the color filter may be formed on the TFT array substrate.

In addition, in the aforementioned embodiment, the liquid crystal device is described. However, an electro-optical device such as an organic EL device having an electro-optical panel including a pair of substrates made of a transmissive material which interpose an electro-optical material layer made of an organic light emitting material that emits light according to an applied voltage may be employed. In a case where the electro-optical device is employed by the present invention, as described above, although the intensities different from actual intensities of a portion of the light receiving elements are detected, it is possible to prevent an erroneous conversion of the display state of an image displayed on the electro-optical panel. In addition, the voltage applied to the electro-optical panel is optimized, and an excessive voltage is not applied to the electro-optical material layer. Therefore, it is possible to prolong life cycle of the electro-optical material layer. Here, the electro-optical device is not limited to the organic EL device, but any other electro-optical devices including electro-optical penal may be used.

In addition, in the aforementioned embodiment, an electronic apparatus including the liquid crystal device is described. However, an electronic apparatus including an electro-optical device may be employed.

In addition, although the peripheral shielding layer is formed on the opposite substrate, the peripheral shielding layer may be partially or entirely placed on the TFT array substrate as an embedded shielding layer.

In addition, although the timing generator, the power source circuit, the backlight control circuit are connected to the signal line driving circuit, the scanning line driving circuit, the light receiving element, and so on via the flexible board, some or all of them may be formed on the TFT array substrate, similarly to the signal line driving circuit or the scanning line driving circuit.

On the surface of the TFT array substrate, in addition to the above signal line driving circuit, the scanning line driving circuit, and so on, a sampling circuit that samples and supplies an image signal to a signal line, a pre-charge circuit that supplies a pre-charge signal of a specific voltage to a plurality of signal lines, respectively, prior to the image signal, and a test circuit that tests a mobile phone in terms of quality or defect thereof in a manufacturing or shipment process.

Although the signal line driving circuit or the scanning line driving circuit is formed on the upper surface of the TFT array surface, the invention may have a structure in which a COF (Chip On Film) substrate mounted with a driving LSI having a function of such as the signal line driving circuit or the scanning line driving circuit is electrically and mechanically connected to the scanning line and the signal line of the TFT array substrate via an anisotropic conductive material.

Phase difference plates may be disposed inside a pair of polarizing plates, respectively. In this case, as a phase difference plate, a circular polarizing plate may be constructed along with the pair of polarizing plates by using a $\lambda/4$ plate having a phase difference of approximately ¼ wavelength with respect to a wavelength in a visible light range. In addition, a broadband circuit polarizing plate may be constructed by combining a $\lambda/2$ plate and a $\lambda/4$ plate.

An optical compensation film may be optionally placed on either one or both of inner surfaces of the pair of polarizing plates. By using the optical compensation film, a phase difference of the liquid crystal layer can be compensated for when the liquid crystal device is seen from a plan view or a perspective view, so that light leakage can be reduced so as to increase contrast. In this case, the optical compensation film may be a negative uniaxial medium which is constructed by aligning a discotic liquid crystal molecule or the like having a negative refraction index anisotropy in a hybrid manner. In addition, a positive uniaxial medium may be used which is constructed by aligning a nematic liquid crystal molecule or the like having a positive refraction index anisotropy in a hybrid manner. Furthermore, the negative uniaxial medium and the positive uniaxial medium may be combined for use. In addition, a double axial medium of which refraction indices in every direction thereof meet the relation of $nx>ny>nz$, a negative C-plate, or the like may be used.

Although the mobile phone is used as an electronic apparatus according to the above embodiments, the invention is not limited to the mobile phone. In other words, if a display unit using the liquid crystal device of the invention is placed, the electronic apparatus may be other types of electronic apparatus such as an electronic book or projector, a personal computer, a digital still camera, a television set, a view finder type or monitor direct-view type video tape recorder, a car navigation system, a pager, an electronic scheduler, a calculator, a word processor, a workstation, a video telephone, a POS terminal, a PDA (Personal Digital Assistant), a touch panel, or the like.

The entire disclosure of Japanese Patent Application No. 2005-284456, filed Sep. 29, 2005 is expressly incorporated by reference herein.

What is claimed is:

1. A liquid crystal device comprising:

a liquid crystal panel including a pair of substrates which interpose a liquid crystal layer;

a plurality of light receiving elements which continuously detect ambient light; and a control unit which adjusts an overall brightness level of an image displayed on the liquid crystal panel due to a change in the intensity of the ambient light detected by a plurality of the light receiving elements, wherein the control unit includes a determination unit—that repeatedly determines that the intensity of the ambient light is changed when changed amounts of the intensities of the ambient light detected by more than half of the light receiving elements exceed a threshold value, the changed amounts occurring during a predetermined time interval, and wherein the control unit maintains the overall brightness level when the changed amounts of the intensities of the ambient light detected by not more than half of the light receiving elements exceed a threshold value.

2. The liquid crystal device according to claim 1, further comprising an illumination unit which irradiates illumination light on a rear surface of the liquid crystal panel, wherein the control unit controls an intensity of the illumination light based on the determination of the determination unit.

3. An electronic apparatus comprising the liquid crystal device according to claim 1.

4. The liquid crystal device as set forth in claim 1, the plurality of light receiving elements being arranged so as to be positioned in a region outside of an image display region of the liquid crystal panel and on one side with respect to the image display region of the liquid crystal panel and on another side opposite to the one side.

5. A light emitting device comprising:

an electro-optical panel including a pair of substrates which interpose an electro-optical material layer;

a plurality of light receiving elements which continuously detect ambient light; and a control unit which adjusts an overall brightness level of an image displayed on the electro-optical panel due to a change in the intensity of the ambient light detected by a plurality of the light receiving elements, wherein the control unit includes a determination unit that repeatedly determines that the intensity of the ambient light is changed when changed amounts of the intensities of the ambient light detected by more than half of the light receiving elements exceed a threshold value, the changed amounts occurring during a predetermined time interval, and wherein the control unit maintains the overall brightness level when the changed amounts of the intensities of the ambient light detected by not more than half of the light receiving elements exceed a threshold value.

6. An electronic apparatus comprising the light emitting device according to claim 5.

7. A method of controlling a liquid crystal device including a liquid crystal panel including a pair of substrates which interpose a liquid crystal layer and a plurality of light receiving elements which detect ambient light, the method comprising:

continuously detecting an intensity of the ambient light by using a plurality of the light receiving elements in a predetermined time interval; and adjusting an overall brightness level of an image displayed on the liquid crystal panel due to a change in the detected intensity of the ambient light, such change determined by the intensity of the ambient light that is changed when changed amounts of the intensities of the ambient light detected by more than half of the light receiving elements exceed a threshold value, the changed amounts occurring during a predetermined time interval, and wherein the control unit maintains the overall brightness level when the changed amounts of the intensities of the ambient light detected by not more than half of the light receiving elements exceed a threshold value.

8. A method of controlling a light emitting device including an electro-optical panel including a pair of substrates which interpose an electro optical material layer and a plurality of light receiving elements which continuously detect ambient light, the method comprising:

detecting an intensity of the ambient light by using a plurality of the light receiving elements in a predetermined time interval; and adjusting an overall brightness level of an image displayed on the electro-optical panel due to a change in the detected intensity of the ambient light, such change determined by the intensity of the ambient light that is changed when changed amounts of the intensities of the ambient light detected by more than half of the light receiving elements exceed a threshold value, the changed amounts occurring during a predetermined time interval, and wherein the control unit maintains the overall brightness level when the changed amounts of the intensities of the ambient light detected by not more than half of the light receiving elements exceed a threshold value.

* * * * *